US009987740B2

(12) United States Patent
Metcalf

(10) Patent No.: US 9,987,740 B2
(45) Date of Patent: Jun. 5, 2018

(54) VENT MANIPULATION SYSTEM

(71) Applicant: Don Metcalf, Mattoon, IL (US)

(72) Inventor: Don Metcalf, Mattoon, IL (US)

( * ) Notice: Subject to any disclaimer, the term of this patent is extended or adjusted under 35 U.S.C. 154(b) by 140 days.

(21) Appl. No.: 14/941,098

(22) Filed: Nov. 13, 2015

(65) Prior Publication Data

US 2017/0136616 A1 May 18, 2017

(51) Int. Cl.

| | |
|---|---|
| ***B25G 1/04*** | (2006.01) |
| ***F24F 13/14*** | (2006.01) |
| ***B25B 13/50*** | (2006.01) |
| ***B25B 13/48*** | (2006.01) |

(52) U.S. Cl.

CPC ..... *B25G 1/043* (2013.01); *B25B 13/48* (2013.01); *B25B 13/50* (2013.01); *F24F 13/1426* (2013.01)

(58) Field of Classification Search

CPC ..... B25B 13/50; B25B 13/48; B25G 1/043; F24F 13/1426; F24F 2013/1446; F24F 2013/1473

USPC ..... 81/53.1, 484

See application file for complete search history.

(56) References Cited

U.S. PATENT DOCUMENTS

| | | | | |
|---|---|---|---|---|
| 519,354 | A * | 5/1894 | Sheppard | H01H 23/141 200/331 |
| 588,438 | A * | 8/1897 | Johnson et al. | B25B 13/48 411/402 |
| 3,360,291 | A | 12/1967 | Barrett | |
| 3,962,748 | A * | 6/1976 | Michaels | B25J 1/04 16/429 |
| 4,203,332 | A | 5/1980 | Corsetti | |
| 5,016,504 | A | 5/1991 | Brunetto et al. | |
| 5,341,707 | A * | 8/1994 | Bond | B25B 7/00 81/436 |
| 6,142,867 | A * | 11/2000 | Lee | F24F 13/06 137/556.3 |
| 6,464,579 | B1 * | 10/2002 | Salazar | F24F 13/065 454/202 |
| 6,959,468 | B1 | 11/2005 | Danger | |
| 8,075,031 | B2 | 12/2011 | Walker, Jr. | |
| 8,671,805 | B2 * | 3/2014 | Henderson | B25B 13/481 29/813 |
| 2015/0357145 | A1 * | 12/2015 | Shaps | H01K 3/32 81/53.11 |

* cited by examiner

*Primary Examiner* — Hadi Shakeri

(57) ABSTRACT

A vent manipulation system includes a building that has a ceiling and a floor. The ceiling is spaced from the floor and the ceiling is inaccessible without a ladder. A vent is coupled to the ceiling and the vent may pass air through the ceiling. A tool is provided and the tool may be manipulated. The tool engages the vent such that the tool adjusts the vent between an open position and a closed position. Thus, the tool adjusts the vent without the ladder.

2 Claims, 5 Drawing Sheets

VENT MANIPULATION SYSTEM

BACKGROUND OF THE DISCLOSURE

Field of the Disclosure

The disclosure relates to manipulation devices and more particularly pertains to a new manipulation device for adjusting a vent on a ceiling.

SUMMARY OF THE DISCLOSURE

An embodiment of the disclosure meets the needs presented above by generally comprising a building that has a ceiling and a floor. The ceiling is spaced from the floor and the ceiling is inaccessible without a ladder. A vent is coupled to the ceiling and the vent may pass air through the ceiling. A tool is provided and the tool may be manipulated. The tool engages the vent such that the tool adjusts the vent between an open position and a closed position. Thus, the tool adjusts the vent without the ladder.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
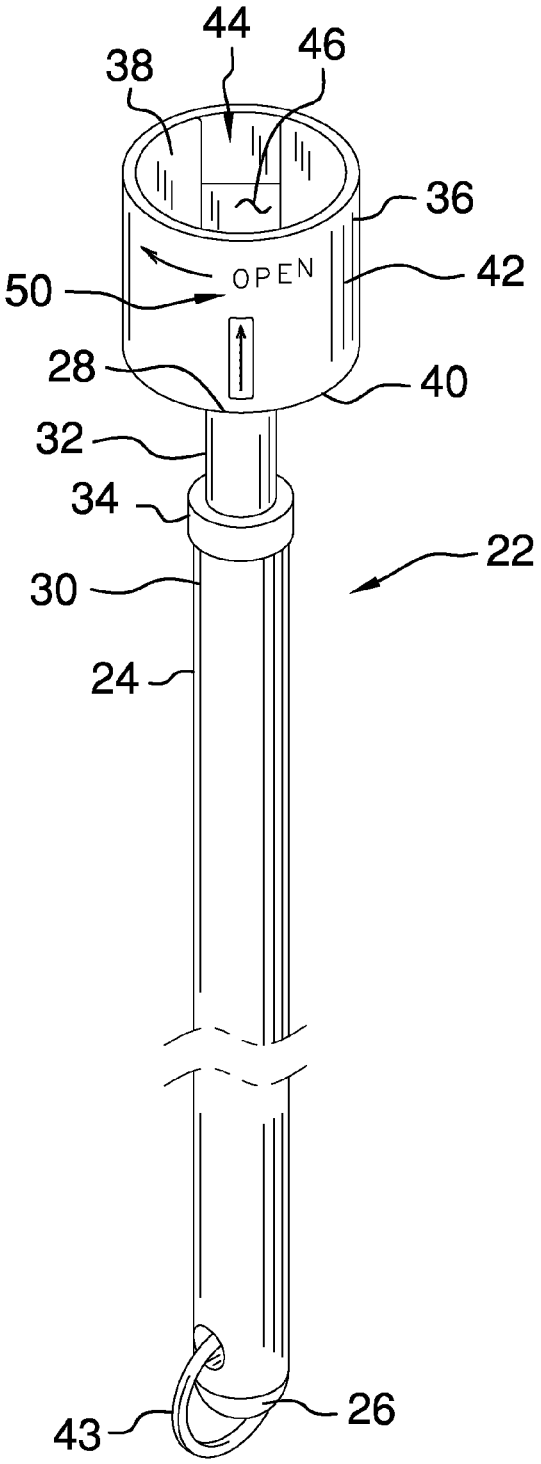
FIG. 1 is a perspective view of a vent manipulation system according to an embodiment of the disclosure.
Figure 2:
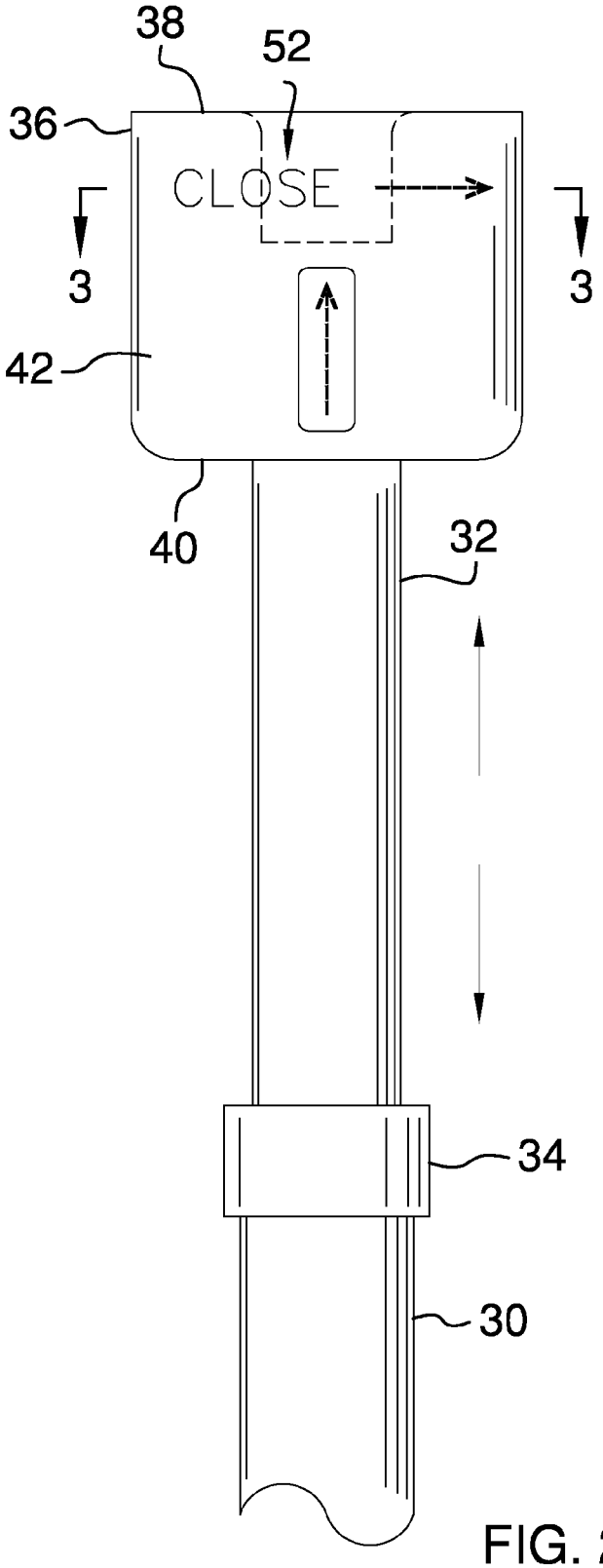
FIG. 2 is a right side view of an embodiment of the disclosure.
Figure 3:
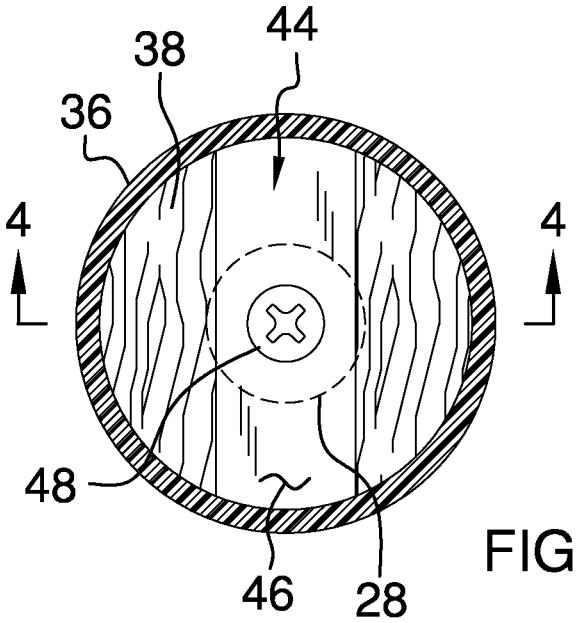
FIG. 3 is a cross sectional view taken along line 3-3 of FIG. 2 of an embodiment of the disclosure.
Figure 4:
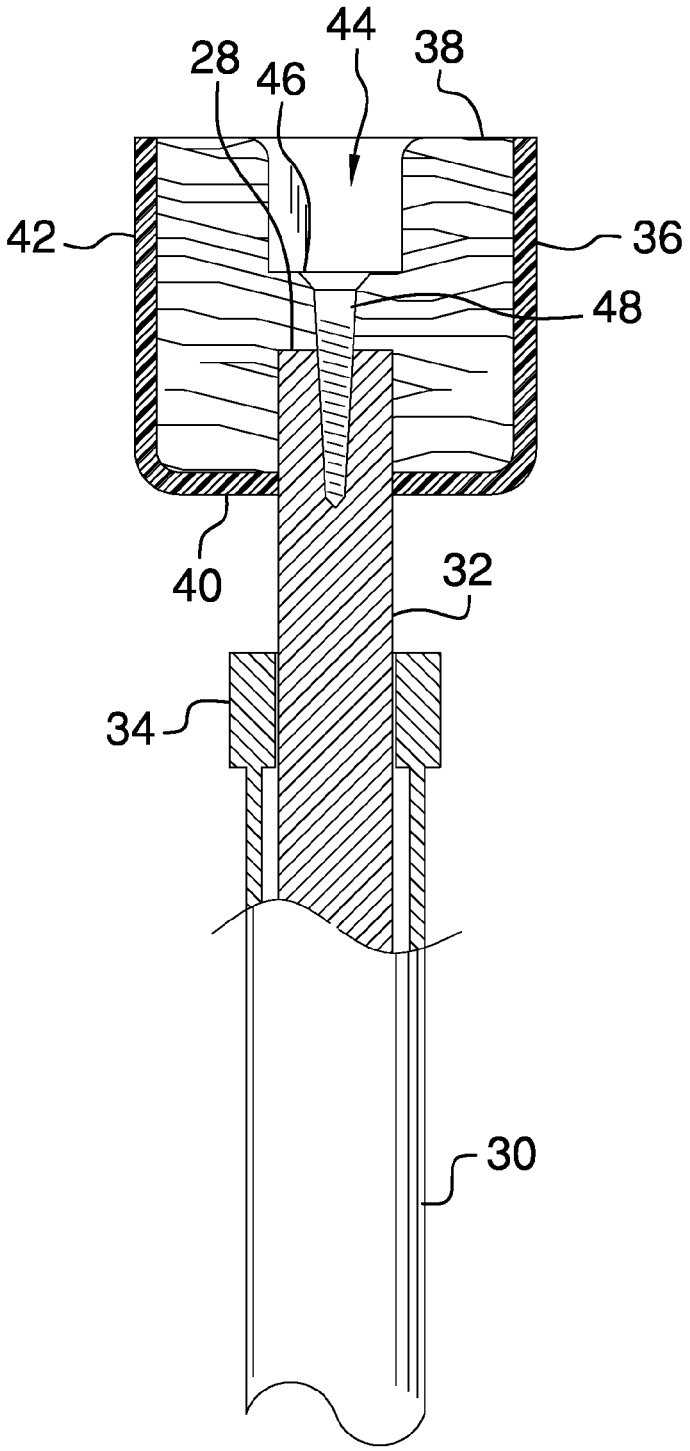
FIG. 4 is a cross sectional view taken along line 4-4 of FIG. 3 of an embodiment of the disclosure.
Figure 5:
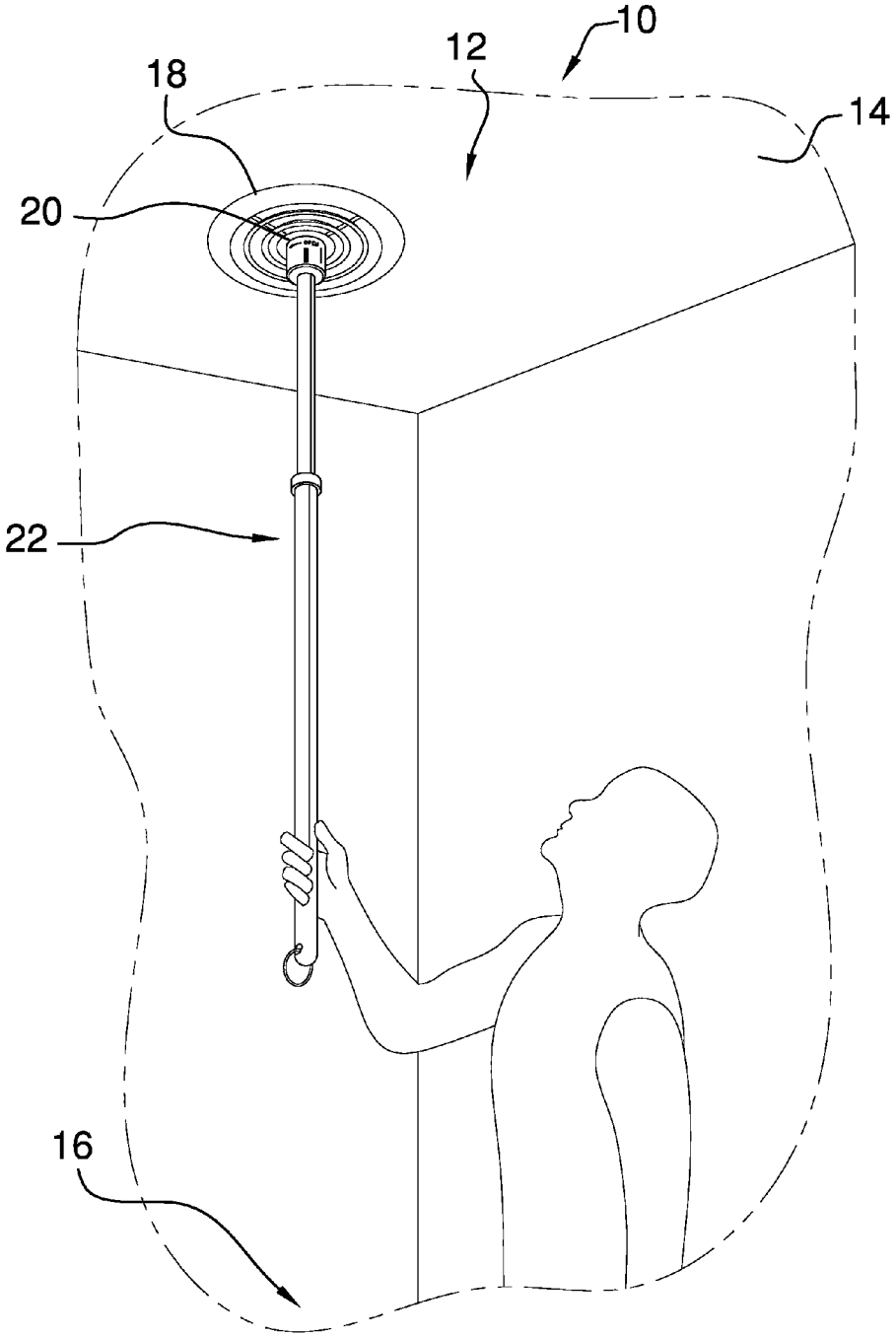
FIG. 5 is a perspective in-use view of an embodiment of the disclosure.

With reference now to the drawings, and in particular to FIGS. 1 through 5 thereof, a new manipulation device embodying the principles and concepts of an embodiment of the disclosure and generally designated by the reference numeral 10 will be described.

As best illustrated in FIGS. 1 through 5, the vent manipulation system 10 generally comprises a building 12 that has a ceiling 14 and a floor 16. The ceiling 14 is spaced from the floor 16. The ceiling 14 may be spaced from the floor 16 a distance ranging between approximately two meters and four meters. Thus, the ceiling 14 is inaccessible without a ladder. The building 12 may be a residential structure or the like.

A vent 18 is coupled to the ceiling 14 and the vent 18 may pass air through the ceiling 14. The vent 18 has a central hub 20. The central hub 20 may be manipulated thereby facilitating the vent 18 to pass a selected volume of air through the ceiling 14. The vent 18 may comprise a circular air diffuser or the like.

A tool 22 is provided and the tool 22 may be manipulated. The tool 22 engages the vent 18 such that the tool 22 adjusts the vent between an open position and a closed position. Thus, the tool 22 may adjust the vent 18 without the use of the ladder. The tool 22 comprises a handle 24 has a first end 26 and a second end 28. The handle 24 has a first portion 30 that is slidably coupled to a second portion 32 such that the handle 24 has a telescopically adjustable length.

A collar 34 is rotatably coupled to the first portion 30. The collar 34 is manipulated to frictionally engage the second portion 32. Thus, the collar 34 retains the handle 24 at a selected length. The collar 34 is manipulated to facilitate the second portion 32 to slide freely in the first portion 30. The handle 24 may be adjustable to a length ranging between approximately one meter and four meters.

A cup 36 is provided. The cup 36 has a top side 38, a bottom side 40 and a peripheral side 42 extending between the top side 38 and the bottom side 40. The peripheral side 42 is curved such that the cup 36 has a cylindrical shape. The bottom side 40 is coupled to the second end 28 of the handle 24. A ring 43 extends through the handle 24 and the ring 43 is positioned adjacent to the first end 26. The ring 43 may be coupled to a support thereby facilitating the handle 24 to be stored.

The top side 38 has a well 44 extending downwardly therein. The well 44 is centrally positioned on the top side 38. The well 44 extends substantially across the top side 38. The well 44 has a lower bounding surface 46. A fastener 48 may extend through the lower bounding surface 46 and engage the second end 28. The fastener 48 may comprise a screw or the like. The cup 36 may additionally be an integral component of the handle 24.

The peripheral side 42 has a first set of indicia 50 printed thereon. The first set of indicia 50 may comprise the word "open" and a corresponding arrow pointing in a clockwise direction. The peripheral side 42 has a second set of indicia 52 printed thereon. The second set of indicia 52 may comprise the word "close" and a corresponding arrow pointing in a counterclockwise direction. Additionally, each of the first set of indicia 50 and the second set of indicia 52 may comprise an arrow pointing toward the top side 38.

In use, the handle 24 is adjusted to a selected length and the collar 34 is manipulated to retain the handle 24 at the selected length. The tool 22 is manipulated to position the central hub 20 within the well 44. The tool 22 is manipulated to urge the central hub 20 to rotate in a first direction. Thus, the vent 18 may pass a maximum amount of air through the ceiling 14. The tool 22 is manipulated to urge the central hub 20 to rotate in a second direction. Thus, the vent 18 may pass a minimum amount of air through the ceiling 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A vent manipulation tool configured for adjusting a vent positioned in a ceiling over a floor such that the vent is inaccessible by hand without a ladder, said tool comprising:

a handle having a first end and a second end, a cup having a top side, a bottom side and a peripheral side extending between said top side and said bottom side, said peripheral side being curved such that said cup has a cylindrical shape, said bottom side being coupled to said second end of said handle, and a well extending downwardly into said cup, said well being centrally positioned on said top side, said well extending substantially across said top side, said well having a substantially rectangular cross-sectional shape perpendicular to a longitudinal axis of said well, and indicia positioned on an outer surface of said peripheral side of said cup, said indicia comprising an arrow, said arrow pointing to said top side of said cup, said arrow being aligned with said well wherein said arrow is configured to facilitate alignment of said well to engage said vent.

2. The system according to claim 1, further comprising said handle having a first portion being slidably coupled to a second portion such that said handle has a telescopically adjustable length.

* * * * *